United States Patent [19]

Brewer et al.

[11] Patent Number: 4,834,266

[45] Date of Patent: May 30, 1989

[54] VALVE WITH SAFETY VENT SEAL

[75] Inventors: Andrew J. Brewer, Canoga Park; Jeffrey W. Gunn, Thousand Oaks; James P. Hagan, Chatsworth, all of Calif.

[73] Assignee: APV Rosista, Inc., Rockford, Ill.

[21] Appl. No.: 56,350

[22] Filed: May 27, 1987

Related U.S. Application Data

[63] Continuation-in-part of Ser. No. 895,161, Aug. 11, 1986, abandoned, and Ser. No. 887,741, Jul. 18, 1986, abandoned.

[51] Int. Cl.[4] ..... B65D 47/02

[52] U.S. Cl. ..... 222/147; 222/400.7; 137/212; 251/297; 251/120

[58] Field of Search ..... 137/513.3, 513.5; 251/120

[56] References Cited

U.S. PATENT DOCUMENTS

| | | | |
|---|---|---|---|
| 2,937,658 | 5/1960 | Stewart | 137/513.3 X |
| 3,410,456 | 11/1968 | Johnson, Jr. et al. | 222/400.7 X |
| 3,460,721 | 8/1969 | Hamel et al. | 222/541 X |
| 3,828,973 | 8/1974 | Birrell | 222/541 X |
| 3,846,518 | 11/1974 | McPhee | 222/400.7 X |
| 3,939,860 | 2/1976 | Golding | 222/400.7 X |
| 4,343,325 | 8/1982 | Fallon | 222/400.7 |
| 4,488,572 | 12/1984 | Brown et al. . | |
| 4,543,980 | 10/1985 | van der Sanden | 222/147 X |
| 4,573,611 | 3/1986 | O'Connor | 222/147 |

*Primary Examiner*—Joseph J. Rolla
*Assistant Examiner*—Gregory L. Huson
*Attorney, Agent, or Firm*—Elliott N. Kramsky

[57] ABSTRACT

A safety vent seal assures a release path for the residual volatile beverage that can be expected to be found within a disposable container. The container is sealed by a a inner valve is urged toward a sealing relationship with an outer valve member by a semi-compressed spring and the second valve is urged toward a sealing relationship with the valve body by a second semi-compressed spring. The safety vent seal may be located either between the inner valve and the outer valve or between the outer valve and the valve body. In the former case, the safety vent seal is generally cross-shaped while, in the latter case, the seal is generally "C-shaped". In both configurations, the seal expands as a consequence of the tapping of the valve and inserts itself into an otherwise-sealed relationship either cross-shaped and or C-shaped fitted atop the first, or ball, member and within an aperture in the sealing member or fitted within a notch of the outer valve adjacent abutment with the valve body respectively. Upon the opening of the valve (by means of a keg tap or the like) edges of the seal that are compressed when fitted within the aperture notch expand, preventing the valve from resealing when the tap is removed.

12 Claims, 4 Drawing Sheets

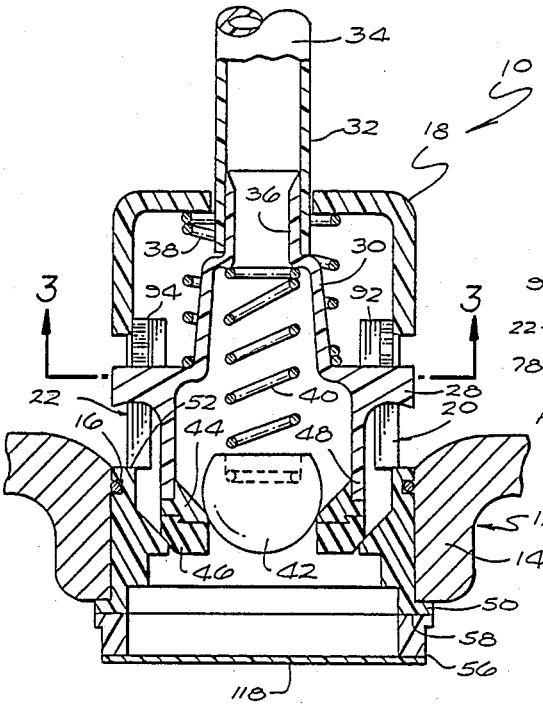
FIG. 1
FIG. 3
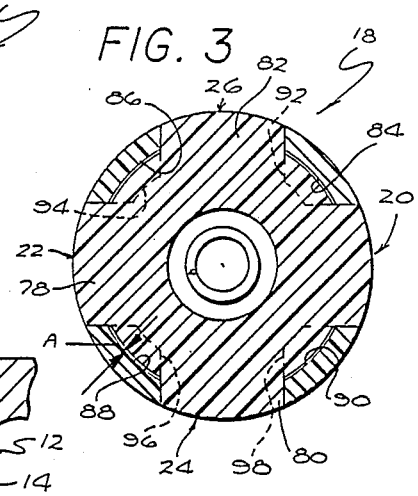
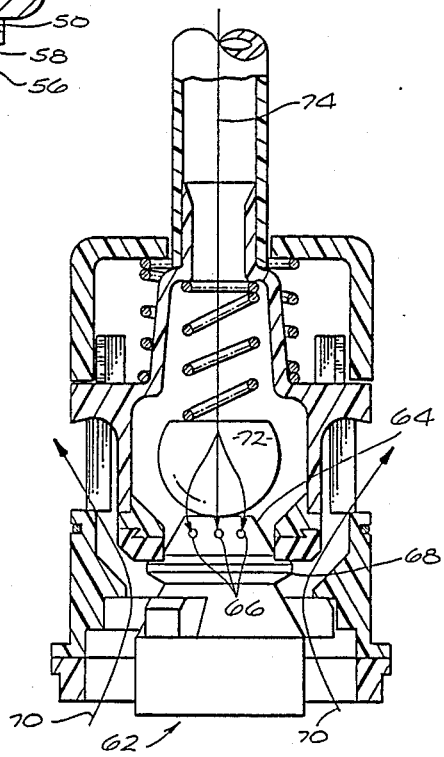
FIG. 2

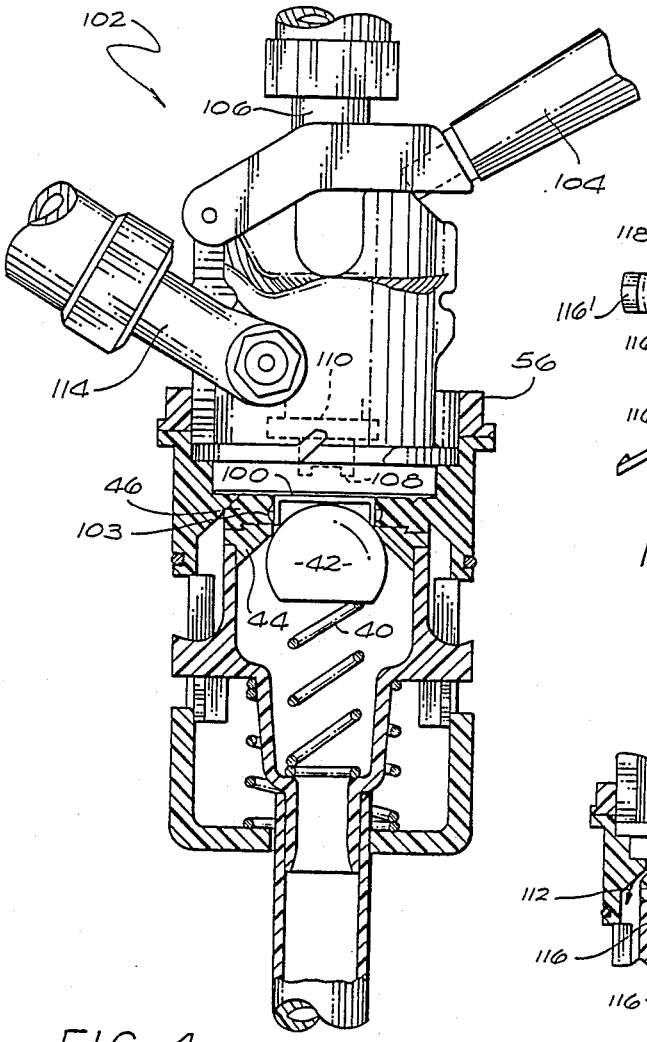
FIG. 4
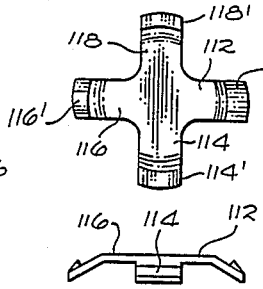
FIG. 5
FIG. 6
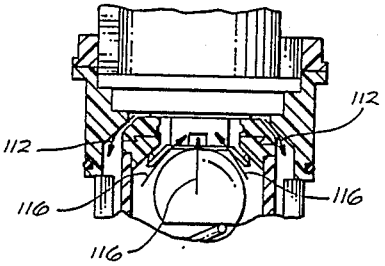
FIG. 7
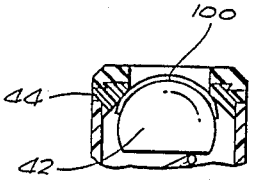
FIG. 8

VALVE WITH SAFETY VENT SEAL

REFERENCE TO RELATED APPLICATION

This application is a continuation-in-part of U.S. patent application Ser. No. 895,161 of Brewer, Gunn and Hagan entitled "Valve With Safety Vent Seal" filed Aug. 11, 1986.

BACKGROUND

1. Field of the Invention

The present invention relates to valves for use in conjunction with the filling and dispensing of beer and related liquids from keg-like containers. More particularly, this invention pertains to apparatus for enhancing the safe disposal of "throwaway" containers for carbonated beverages.

2. Description of the Prior Art

In the past, large volumes of beer for consumption have been stored, shipped in and dispensed from metal kegs of closed or single entry design. In such a keg, a so-called Sanke system is nearly-universally employed for regulating the flow of beer into and from the keg. A Sanke system comprises a spear tube and a valve of the type that includes inner and outer valved chambers to accommodate flows of pressurizing gas and of liquid responsive to the force exerted by such pressurizing gas.

Automatic washing and racking apparatus cleans, sterilizes and refills the combination of keg and valve. The reprocessing of such containers can be relatively expensive. However, the relatively substantial investment represented by such a system makes it mandatory to invest in such repeated processing.

Sanke-type valves commonly include apertures that permit the pressurized flow of beverage to impact the bottom of the (inverted) keg with great force during the filling or racking process. As a result, the beverage is substantially agitated and, in the case of beer, a substantial amount of foam or "head" is generated. As will be explained below, this head is quite undesirable in terms of both beverage waste and flavor.

Efforts to reduce cost have led to the development plastic kegs for throw-away use. Such kegs are sold as a unit that includes a valve and beverage for picnic and related uses. The plastic keg is routinely of spherical design and includes a top, crimped to the mouth of the keg, that has a pair of flapper valves therein. One of such valves regulates a flow of pressurizing gas and the other regulates beverage flow. Unlike the metal kegs that include Sanke-type valves, plastic keg systems are filled with beverage prior to crimping the flapper valve top. As a result, anerobic bacteria often contaminate the beverage which results, in the case of beer, in an unsatisfactorily short shelf life.

Dewes, Gunn and Hagan have disclosed a new valve system in pending U.S. patent application Ser. No. 887,741, referenced above, that is adapted to enhance and facilitate, and therefore render more feasible, the use of throwaway containers for beverages, including those, such as soft drinks and beer, that contain carbonation. While the advantages of such throwaway containers are apparent, their use can lead to problems that are not encountered in the use of reusable containers.

An unavoidable residual amount of beverage exists in a keg or other container after it is effectively "empty". This can result from a number of factors including the distance between the bottom of the spear and the bottom of the container, insufficient pressurization of the beverage and container geometry. While no particular problem is posed by such residual beverage in a reusable metal keg, its presence in a plastic container or keg that is intended, by virtue of its economical price, to be thrown away, can be dangerous.

In plastic containers or kegs of the type that utilize a ball-type valve of the sort discussed in the referenced patent application, the valve is sealed to the container. Thus, an entire unit, including keg and valve will be discarded by the user. As is discussed below, the arrangement of such a valve is urged by spring means into a sealing relationship with the exception of the times in which a filling head or a tap is inserted into, and thereby depresses, the ball valve. Clearly the interior of the keg will be sealed after the tap is removed and the keg is discarded. Often, the user can be expected to discard the keg into an incinerator or to expose the used keg to strong sunlight. In either event, the sealed container, including a residue of carbonated liquid, poses a hazard. Much like an aerosol can, such a keg is subject to explosion.

SUMMARY

The present invention addresses and overcomes the foregoing and additional shortcomings of the prior art by providing, in a first aspect, an improvement in apparatus for dispensing a beverage of the type that includes an inner valve that is urged toward a sealing relationship with an outer valve by means of an inner spring. Such apparatus includes a resilient safety vent seal located between the inner and outer valve. The washer includes means for permitting fluid flow between the inner and outer valves.

In a further aspect, the invention provides a novel valve for a beverage container. The valve includes a valve body. An inner valve includes a first valve member that is urged toward a sealing relationship with a second valve member by a spring. Means are provided for preventing a sealing relationship between the first valve member and the second valve member once the second valve member has been depressed, such means including a cross shaped washer of resilient composition.

In another aspect, the invention provides an improvement in apparatus for dispensing a beverage of the type that includes an inner valve and an outer valve within a valve body, the inner valve being urged toward a sealing relationship with the outer valve by means of an inner spring and the outer valve being urged toward a sealing relationship with the valve body by an outer spring. A resilient ring is provided intermediate the outer valve and the valve body. Such ring includes an aperture for permitting fluid flow between the body and the outer valve.

In yet another aspect, the invention provides yet another improvement in apparatus for dispensing a beverage of the type described above. In accordance with this aspect, the inner valve, the outer valve and the valve body are elastomeric material. The body includes a neck that is generally crown-shaped so that, when joined to a container having a substantially cylindrical neck, a Barnes neck is formed.

The preceding and other features and advantages of this invention will become further apparent from the detailed description that follows. This written description is accompanied by a set of drawing figures. Corresponding numerals of the written description and the drawing figures reference the various features of the invention, like numerals referring to like features throughout both the description and the drawings.

BRIEF DESCRIPTION OF THE DRAWINGS

FIGS. 1 through 3 are various views of a valve particularly adapted for use with a disposable keg;

FIG. 4 is a side sectional view of a valve, including an inner pressure relief washer in accordance with the invention for relieveing pressure, showing a conventional keg tapping apparatus inserted therein;

FIG. 5 is a top plan view of an inner valve pressure relief washer in accordance with the invention;

FIG. 6 is a side elevation view of the pressure relief washer of the preceding figure;

FIG. 7 is a partial side sectional view of a valve in accordance with the invention wherein the head of a conventional keg tap has depressed the inner valve to its open position;

FIG. 8 is a partial side sectional view of the inner valve of FIGS. 4 through 7 after the removal of the conventional tapping apparatus; ]

DESCRIPTION

Figure 9:
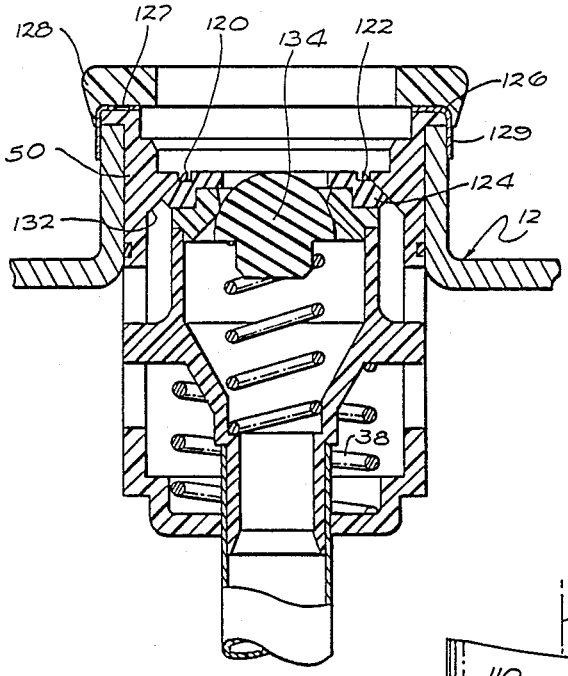
FIG. 9 is a side sectional view of an alternative embodiment of a valve including an outer valve pressure relief ring.

Turning now to the drawings, FIG. 1 is a side sectional view of a valve 10 for use with the invention. The invention of such valve is claimed in pending U.S. patent application Ser. No. 887,741. As shown in FIG. 1, the valve 10 is engaged to the mouth of an appropriate container or vessel 12. However, the valve might be adapted to numerous types of containers and beverages.

As shown in FIGS. 1 and 2, the valve 10 is illustrated in the inverted position that characterizes its attitude during the filling process. This process will be discussed in greater detail below. A significant utility and advantage resides in the manner in which the filling process, utilizing conventional filling apparatus and techniques, is enhanced by such a valve.

Returning now to FIG. 1, the valve 10 can be seen to be sealably secured to the inner side of the mouth 14 of the container 10 by means of an O-ring 16. The ring 16 is seated within a circumferential notch in an outer cage portion 18 of the valve 10. The outer cage 18 is preferably formed of one of a number of appropriate, non-contaminating plastics such as those marketed under the trademarks "Lexann" or "PETG". Throughout the description of the valve 10 that follows reference will be made to valve elements of plastic composition and, unless otherwise noted, materials of the above-reference character and quality may be assumed as representative and appropriate compositions.

The outer cage 18 has a half-closed cylindrical shape that includes a plurality of apertures 20, 22, 24 and 26, the latter two of which are indicated only in FIG. 3, a sectional view taken along the line 3—3 of FIG. 1. Each of the apertures is oriented lengthwise in the cylindrical surface of the outer cage 18. As will be discussed below, the tapered apertures provide clearance for the tab-like transverse extensions of a deflector plate 28 that is integral, and therefore movable with, an inner cage 30. The lengthwise apertures of the outer cage 18 permit the cooperative movement of the valve elements. As will be discussed below, the design of the valve 10 effectively prevents the undesired spraying of liquid toward and against the bottom of the inverted container 12 when the valve is urged or moved to the open position during the filling process. The occurrence of such vertical spraying would, in the case of beer, waste and seriously degrade the quality of the product.

An aperture 32 in the top of the outer cage 18 provides clearance between it and a down tube 34. The down tube 34, which is preferably of compatible plastic composition, provides a conduit for pressurized backfill gas whose flow may be automatically monitored at a conventional fill stand. After the keg has been filled, the liquid within the keg is forced upward through the tube 34.

The length of the tube 34 is chosen in accordance with the depth of the container 12. It is fixed to, and therefore movable with, the inner cage 30 of the valve 10. An interference fit between the tube 34 and the lower end 36 of the inner cage 30 secures this relationship.

The inner cage 30 is preferably a molded plastic piece. As mentioned above, this element of the valve 10 is movable with respect to the outer cage 18 and induces lengthwise movement of the tube 34 through the clearance provided by the aperture 32 in the top of the outer cage 18.

An outer spring 38, which abuts the inner cage 30 adjacent the base of the transversely-oriented deflector plate 28, urges the inner cage to the "closed" configuration of FIG. 1. As will be seen in FIG. 2, by inserting a filling head, the force of the spring 38 is counteracted, permitting an "open" relationship between the inner and outer cages that allows the container to be filled.

The valve 10 is designed, in accordance with the general configuration and operation of Sanke-type systems, to seal (closed position) and to permit flows into the container 12 through the apertures in the side of the stationary outer cage 18 and out of the container 12 through the down tube 34 and the chamber within the inner cage 30 (open position). The valve 10 is urged to a closed configuration by the outer spring 38, which closes the path of fluid flow into the container 12 through the apertures of the outer cage 18, and an inner spring 40 that abuts the interior of the inner cage 30 and exerts a downward force upon a semi-spherical inner valve 42. As will be seen, the flow paths mentioned above are commonly opened by the insertion of a filling head or a conventional keg tap.

The inner valve 42 is preferably formed of rubber or the synthetic elastomeric material that is commercially available under the trademarks "EPDM" and Buna-N. The lower end of the spring 40 is integral with (molded into) the valve 42. By forming the spring 40-and-valve 42 as a single element, a greater degree of positive control is attained over the opening and closing movement of the valve 42. This is in contrast to prior art valves wherein an independent spring abuts a spherical valve. It is often difficult to maintain the desired alignment of the spring in such a case. The bottom of the spring may contact the spherical upper surface of the valve in such a manner as to exert undesired torquing force that destroys the desired spring alignment. This can lead to valve failure as the spherical valve may thereafter be urged by the misaligned spring to a nonfunctional orientation.

The valve 42 is urged by the spring 40 into an abutting relationship with an encircling valve seal that includes a plastic inner portion 44 and an outer portion 46 of rubber, EPDM or like synthetic elastomeric composition. The inner portion 44 of the valve seal is preferably fixed to the inner cage 30 by an acoustic weld 48. As will be seen in following discussions, the inner valve 42 is opened by combination of the counteracting forces of a filling head and the outer spring 38 that effect the inward movement of the spherical valve 42 relative to the surrounding inner cage 30 and valve seal. The particular compositions and design employed with regard to the inner seal differ from those of the prior art which employ a metal spherical valve in abutting relationship to a rubber valve seal. By choosing the semi-spherical valve 42 to be of rubber or like synthetic composition, the inner portion 44 of the valve seal is formed of appropriate composition for acoustic welding, an economical and advantageous process of manufacture, to the inner cage 30.

The outer portion 46 of the inner valve seal abuts, under the force applied by the outer spring 38, an encircling valve body 50 formed of compatible plastic composition. The valve body 50 is fixed to the outer cage 18 by means of an acoustic weld 52. The relationship between the upper portion 46 of the inner valve seal and the valve body 50 defines the fluid flow path into the container 12 through the apertures in the outer cage 18. As will be seen below, this flow path is opened by the force exerted by a recessed flange or collar of a conventional filling head which counteracts the closing force exerted by the outer spring 38.

A lug ring 56, fixed to the body 50 by means of an acoustic weld 58, provides a means for attaching a conventional tapping apparatus to the container 12. Any conventional apparatus may be conveniently fixed to the valve 10 for operation as a dispenser. The ring 56 is also designed with regard to conventional apparatus for filling a container 12 whereby the required access of the filling head, as shown in FIG. 2, is assured.

FIG. 2 is a side sectional view of the valve in its open configuration. The valve 10 has been urged to this open position, whereby fluids (gases and liquids) can flow through the longitudinal apertures in the outer cage 18 and through the inner valve 42 by the insertion of a filling head of conventional design. The filling head 62 terminates in a truncated cone 64 that includes a plurality of orifices 66. The cone 64 is integral with a circular flange 68 and the inner diameter of the valve seal is preferably no greater than that of the base of the cone 64. By employing such relative dimensions, the filling head 62 may be inserted into the valve 10 substantially as shown in FIG. 2. As can be seen from this figure, the insertion of the head 62 opens both the inner valve 42 and the "outer valve" (i.e. the chamber of the valve 10 that lies between the inner cage 30 and the outer cage 18.) The former portion of the valve 10 is opened by the pressure or force exerted by the truncated cone 64 against the inner valve 42 while the latter portion is opened by the force of the circular flange 68 of the head 62 against the upper portion 46 of the valve seal.

The filling head 62 is part of conventional keg washer-racker apparatus that is capable of automatically performing a number of conventional processes including washing, sterilizing and filling a keg with beer or the like. As the valve is compatible with either a throw-away plastic container or a reusable metal container, the cycle and number of operations performed in the filling-/refilling operation is variable. However, the valve 10 is fully compatible with a conventional automatic washer-racker apparatus, whatever its selected cycle of operation.

Commercially available washer-racker systems include machines manufactured and sold under the trademarks "Centrimatic", "BRT 2", "Minipak" and "Centripak" by APV Burnett & Rolfe Ltd. of the United Kingdom. Such machines normally include both a washing head and a racking or filling head. In the event that a keg is to be recycled, it is first run through a cleaning and sterilization cycle on the washing head. The keg, including valve 10, is then moved to the filling head and installed as shown in FIG. 2 (i.e. inverted). A conventional filling or racking cycle is then performed that may include steaming the keg or container to a set temperature and maintaining such temperature for a predetermined time period; introducing carbon dioxide gas into the container (through the outer valve) to purge the steam (through the inner valve) and condensate; building up a pre-set back pressure within the container 12; and then filling the container with liquid.

Referring back to FIG. 2, numeral 70 indicates the direction of flow into the container 12 from a racking or filling machine as described above. As is seen, the beer or other liquid enters the container through the outer valve. That is, it enters through the apertures in the outer cage 18.

After an appropriate level of back or counter pressure is reached in the container 12 and filling has begun, apparatus within the racker permits a controlled flow of pressurized gas from its interior which is sensed by the racker. The purpose of the counter pressure is to suppress the buildup of foam or "head" that normally occurs when beer or a carbonated beverage is agitated. The gaseous outflow (whose path is indicated at 72) is anaylzed by a conductivity probe associated with the automatic racking machinery. The probe, which is arranged to detect the presence of liquid—as opposed to gaseous—flow in the down tube 34, actuates valving which turns off the beverage input. The probe cannot detect the presence of commingled liquid when a foam or head "mixture" is output from the container; rather this fluid flow is sensed as gaseous.

Foam generated during the filling process thus represents a waste of beverage and cannot be recycled. Further, it has been found that, when a significant amount of foam is generated, the carbon dioxide backpressure can "drive" the gaseous head into the beer, degrading the taste of the product.

In the valve, the harmful effects that result from the buildup of undesirable head during the filling or racking process are minimized by providing a design that minimizes the amount of turbulence or agitation that is encountered by the beverage during the filling process. In a conventional Sanke-type valve, beer (which enters under pressure from the racking machine) is free to travel and exit along the direction of the axis of the valve and may impact the bottom of the inverted keg with significant force. Further agitation, of course, occurs as the beer is pulled to the top of the inverted keg by gravity. Significant agitation does not subside until the beer has filled the container to the point that the apertures through which the pressurized liquid exits the valve are thoroughly submerged. This can, of course, result in the generation or buildup of a large amount of undesirable head each time a keg is filled.

In the valve 10, the amount of head that is built up during the racking process is predictably minimized by a design that minimizes the agitation of the beverage as it is input by means of a conventional automatic racking or filling machine of the type described above. Prior reference has been made to the deflector plate 28 that is formed integrally with and transverse to the axis 74 of the inner cage 30. The plate 28 acts to prevent the vertical flow of the pressurized liquid beverage input through the valve 10, deflecting its path so that it will not impact the interior of the container 12 with significant momentum.

As is seen in FIG. 2, the plate 28 causes the incoming liquid to flow radially through the apertures 20 through 26 in the side of the outer cage 18. By causing such redirection of the flow 72, the agitation of the liquid in minimized. A number of factors account for this beneficial effect. First, the beverage travels a shorter distance, building up less velocity and momentum, before striking an interior portion of the container 12. Secondly, the deflector plate 28 tends to dissipate the energy of the pressurized beverage flow, further lessening the impact force of the beverage against the container 12. Thirdly, the plate 28 redirects the flow 72 in such a way that it impacts the interior of the container 28 at glancing angles that generate less turbulence and agitation than normal impacts.

As mentioned above, it is highly desirable to interrupt the vertical flow of the input pressurized beverage. While the deflector plate 28 is provided to effect this beneficial result, means are additionally provided to assure that the tolerances required to permit the inner cage 30 to move with respect to the stationary outer cage 18 do not allow significant vertical "leakage" during the filling or racking operation.

FIG. 3 is a sectional view of the valve taken along the line 3—3 of FIG. 1. This view looks toward the down tube 34 from the interior of the inner cage 30. As seen in the figure, the circumference of the deflector plate 28 includes integral tab extensions 76, 78, 80 and 82 which alternate with recessed portions 84, 86, 88 and 90. The tabs are in registration with the longitudinal apertures 20 through 26 in the wall of the outer cage 18.

Small separation distances denoted "A" represent the gaps between the interior of the outer cage 18 and the deflection plate. Pressurized beverages entering the system must pass through either the small aperture 32 or the apertures in the side of the outer cage 18 (after flowing around the tabs of the deflector plate 28) without diversion to a radial path in order to travel vertically and impact the interior of the keg 12 with great force. As set forth above, the geometry of the valve 10 assures that one of a number of tortuous flow paths, each offering a minimal probability of "success", must be traversed to achieve this highly undesirable result.

A plurality of generally pie shaped pieces 92, 94, 96 and 98 is formed integrally with the upper surface of the deflection plate 28. As is most clearly shown in FIG. 3, each piece is aligned with and extends inwardly from a recessed portion of the circumference of the plate 28. The pieces 92 through 94 travel vertically adjacent the cylindrical wall of the valve 10 as it moves between the open and closed positions of FIGS. 1 and 2 to thereby stabilize the attitude of the inner cage 30 and associated deflector plate 28. Thus, undesired "cocking" of the inner cage 30 is prevented that could otherwise effect (i.e. increase) the separation distances indicated in FIG. 3.

The valve is fully compatible with popular spherical containers made of plastic that are particularly suitable for picnic and like use. Unlike other valve arrangements for use with such a container which employ a cap with flapper valves that is crimped onto the keg or other container after it is filled, the beverage is not exposed to anerobic bacteria that can limit shelf life. Further, the valve is fabricated substantially of plastic and elastomeric materials. Economy of fabrication is realized by such choice of materials and the use of relatively cheap acoustic welding procedures. Thus, the illustrated valve provides advantages of a Sanke-type system and offers sufficient economy of manufacture so that the combination container-with-valve unit needn't be reused to be economical. In this way, the costs of recycling expensive metal containers are avoided. Further, the welds of the valve discourage tampering with the contents of the continer.

FIG. 4 is a side sectional view of a valve in accordance with the foregoing description which additionally includes a safety vent seal 100 fitted between the substantially ball-like inner valve 42 and the inner portion 44 of the inner valve seal. As discussed above, the compressed inner spring 40 urges the inner valve 42 toward sealing engagmment with the inner portion 44. The seal 100 is inserted into the valve as shown by means for a conventional spring feeder fitting tool. Barbs 101 that extend from surfaces of the seal 100 interlock with a surrounding circular groove 103 at the interior of the plastic inner portion 44 of the inner valve seal to thereby retain the seal 100 as shown.

The position of the valve and the container as illustrated in FIG. 4 is inverted from the prior views of FIGS. 1 and 2. This inversion is illustrative of the transition of the keg from the filling process to the process of dispersing the beverage content.

As shown in FIG. 4, a conventional tapping head or coupler 102 is inserted and retained within the ring 56. Such apparatus includes a handle 104 for causing a shaft 106 that terminates in a tapping probe 108 to open the inner valve 42. At the same time, a washer 110 that surrounds the shaft 106 urges the outer cage of the valve to an open position.

FIGS. 5 and 6 are top plan and sectional elevation views of the safety vent seal 100 of the invention. As can be seen, the seal is a generally crossshaped configuration comprising an integral arrangement of radially extending arms 112, 114, 116 and 118. As mentioned previously, a barb 101 is formed on the upper surface of each arm for interlocking with a groove 103 in the surrounding inner valve seal.

The seal 100 is formed of resilient material, either molded plastic or stainless steel. Each of the arms of the seal inclines toward its peripheral edge. The resilience of the material employed to form the washer 100 permits the washer to be bent into the shape indicated in FIG. 4 for insertion into the valve. In the indicated configuration, each arm is bent ninety degrees about an effective "hinge" indicated by prime numeral. When the compressive force exerted by the inner valve seal is removed, the resilience of the safety vent seal 100 permits the shape indicated in FIGS. 5 and 6 to be restored.

FIG. 7 is a sectional view of the valve of FIG. 4 after the tapping handle 104 has been lowered to thereby cause the tapping probe 108 and the washer 110 to exert downward pressure upon the inner valve and the inner cage valve respectively. As can be seen, upon moving the handle to the indicated position, the probe 108 contacts the top of the safety vent seal 100 while the washer 110 associated with the shaft 106 contacts the top surface of the lower portion 44 of the inner valve seal that forms a part of the inner cage. The downward pressure exerted by the washer 110 depresses the inner cage (counteracting the upward force of the outer spring 38) while the pressure of the probe 108 displaces the inner valve 42 from sealing engagement with the lower portion 44 of the inner valve seal. As a result of the foregoing, a first fluid flow path 112 is created that allows entry of pressurized gas (through a gas inlet 114) for forcing beverage within the container to flow up the tube 34 and a second fluid flow path 116 is created for such a flow of beverage. The bottom of the probe 108 is open, permitting the beverage to enter the hollow shaft 106 that provides the beverage outlet.

As can be seen in FIG. 7, as the resilient seal 100 is forced downward and out of engagement with the sides of the upper portion 46 of the inner valve seal the arms 112 through 118 extend from the "folded" configuration of FIG. 4 to a less radically inclined attitude approximating the shape of FIG. 5.

FIG. 8 is a partial view of the top of the inner cage of the valve after the coupler 102 has been removed. This occurs after the beverage content of the container has been effectively depleted. That is, after it has become unreasonably difficult to pump additional beverage from the interior of the keg as the fluid level is below the bottom end of the down tube 34. As mentioned previously, the presence of a residue of the carbonated beverage in the throwaway container can create a hazardous situation.

Once the coupler has been removed, the compressed outer spring 38 and inner spring 40 encounter no forces opposing the sealing of the flow paths 112 and 116 as shown in FIG. 7. Without safety vent seal 100 in accordance with the invention, the valve would completely seal the residual beverage, and any gases liberated therefrom by the application of heat, within the keg. However, as shown in FIG. 8, the ends of the arms of the resilient seal 100 remain spread beyond the inner diameter of the inner valve seal after removal of the coupler 112. As a result, the seal 100 does not retract to the position/configuration of FIG. 4. Rather, the end portions of the extended arms become trapped between the inner valve 42 and the lower portion 46 of the inner valve seal.

As a consequence of the interposition of the extended safety vent seal 100 between the valve 42 and the inner valve seal, an airtight seal is not provided between the ball valve 42 and the inner valve seal. As can be seen by reference to FIGS. 8 and 5, areas of the seal 100 adjacent the intersections of the arms 112 through 118 define channels between the valve 42 and the lower portion 46 of the inner valve seal. These channels provide regions through which pressurized gas built up within the container can escape after the coupler 112 has been removed. As mentioned previously, this capability, while not limited to disposable plastic kegs, is especially useful in such containers.

Referring back to FIG. 1, a membrane 118 of an appropriate material, such as aluminum foil, is glued to the ring 56 of the valve after the keg or other container has been filled and prior to being tapped. (The safety vent seal 100 is omitted from this view for purposes of clarity.) In this way, the possibility of contamination of the beverage within the container (which is permanently fixed to the valve) is minimized. Upon transport of the keg to the area of its intended use, the membrane is broken by or prior to the insertion of the coupler 112 into the ring 56. The coupler 112 is not removed until the keg or container is sufficiently depleted of its beverage content that it is ready to be discarded. When the coupler 112 is removed (for future use), the user may dispose of the keg-plus-valve unit, including any carbonated residual contents, without fear of explosion from a buildup of pressure within the container.

FIG. 9 is a side sectional view of an alternative valve embodiment. Unlike the valve of the preceding embodiment, that of FIG. 9 includes an outer valve pressure relief ring 120 whose design and operation are discussed in detail below.

A number of variations exist between the valve of FIG. 9 and that of the preceding embodiment. Some of such differences are relatively insignificant while others are material. Like numerals are utilized in this figure to indicate features, disclosed with reference to the prior embodiment, that remain substantially unchanged in terms of both form and function while new numerals are assigned to significantly modifed and/or new elements. The material compositions of the elements of this embodiment are identical to those of the corresponding elements of the prior embodiment unless otherwise enumerated.

As is shown, the outer relief ring 120 is seated within an annular notch 122 formed in the outer portion 124 of the outer valve seal. As previously disclosed, the compressed outer spring 38 urges the outer valve to a sealing relationship with the encircling valve body 50. As in the prior embodiment, the pressure relief ring 120 may be inserted into the valve as shown in FIG. 9 by means of a conventional spring feeder fitting tool. When inserted, the ring 120, which may be formed of appropriate resilient plastic or metal is somewhat "compressed". That is, the encircling valve body 50 exerts inwardly-directed radial pressure against the ring 120, reducing its diameter and causing energy to be stored by the ring 120 for subsequent expansion. (It will be seen below that the ring 120 is discontinuous, a "C-clip", permitting the indicated compression.) Thus, as seen in FIG. 9, the ring 120 is seen to abut and to be constrained from radial expansion by the valve body 50.

In addition to the presence of a pressure relief ring 120, the valve of FIG. 9 is seen to include a number of additional modifications. A circular metallic skirt 126 is provided. The skirt 126 a plurality of openings, such as the aperture 127, to permit acoustic bonding of the valve body 50 to the neck 128 of the valve. The skirt 126 provides a metallic flange 129 that extends from the valve for crimping by means of a conventional tool to secure the valve to the beverage container 12.

The neck 128 of the valve is generally crown-shaped as shown. As such, the elongated neck of a conventional container 12 combines with and the crown-shaped neck 128 of the valve combined to provide a form that is recognized in the industry as a "Barnes Neck". By so designing the neck 128 of the valve, the apparatus of FIG. 9 is rendered readily compatible with standard filling apparatus designed to accept prior art metallic valves that commonly include a Barnes Neck. In such valves, the entire Barnes Neck structure is incorporated into the valve itself unlike Applicants' invention wherein the recognized shape is a composite of a valve and a conventional container element.

Figure 10:
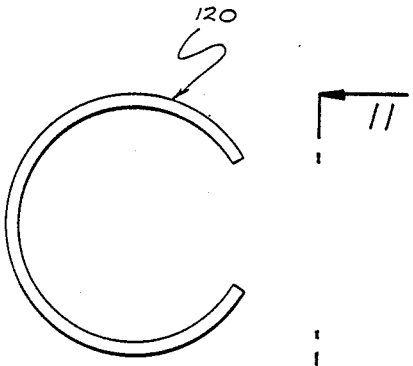
FIG. 10 is a top plan view of an outer valve pressure relief ring in accordance with the alternative embodiment of the invention.
Figure 11:
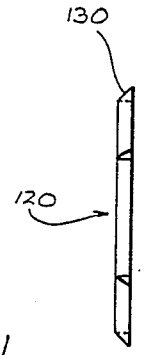
FIG. 11 is a side elevation view of the outer valve pressure relief ring of the preceding figure taken from the aspect indicated at line 11—11 of FIG. 10.

Returning to the pressure relief mechanism of this embodiment, FIG. 10 is a top plan view of an outer valve pressure relief ring 120. As mentioned above, the resilient ring 120 has a discontinuity in its circumference, yielding a C-clip shape that permits compression of its diameter by the inwardly-acting radial force exerted by the encircling valve body 50. Thus, as mentioned above, energy is stored within the ring 120, producing a force that acts outwardly against the valve body 50 when the outer spring 38 forces the outer valve into the sealing relationship of FIG. 9. (It should be further noted that the discontinuity in the ring 120 permits a passageway for pressure that can accumulate within the container 12 after disposal. The significance of this gas relief vent created by the ring 120 will become apparent below.)

FIGF. 12 is a side elevation view of the pressure relief ring 120 taken from the aspect indicated at line 11—11 of FIG. 10. As can be seen from this view, the ring 120 is of generally-triangular cross-section. Thus, the outer edge or circumference 130 of the ring 120 is inclined as shown. The degree of inclination of the circumference 130 substantially matches that of the inclined inner surface 132 of the valve body 50. (This is indicated in FIG. 9.)

FIG. 112 is a side sectional view of a valve in accordance with this embodiment as urged to its "open" or filling configuration by the probe 108 of a conventional tapping apparatus. As shown, the probe 108 depresses the inner valve 134 while the washer 110 of the tapping apparatus opens the outer valve by depressing the outer valve seal 124.

The separation of the outer valve seal 124 from the inclined surface 132 of the valve body 50 removes the inwardly-directed restraint formerly exerted upon the ring 120 by the valve body 50. As a result of this, the energy stored in the formerly-compressed ring 120 is "released" through radial expansion of the ring 120. The matching angles of inclination of the surface 132 of the valve body 50 and the circumference 130 of the ring 120 transforms such radial expansion into the downwardly-directed movement of the ring 120, along the axis 140 of the valve, indicated in FIG. 12.

Figure 12:
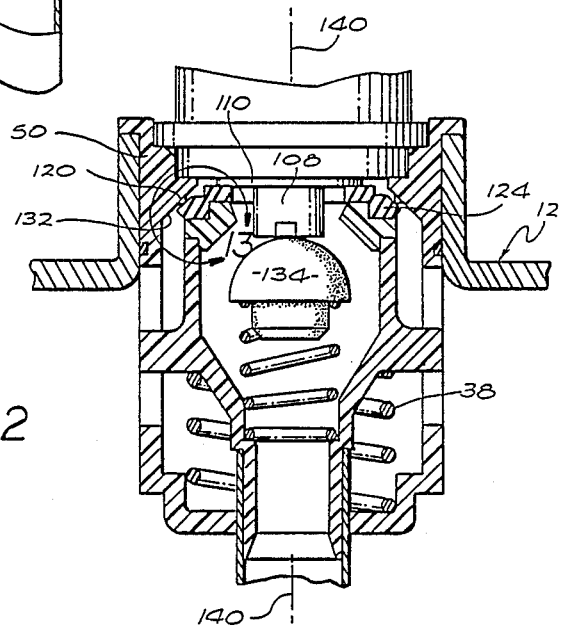
FIG. 12 is a side sectional view of a valve as urged to its "open" or filling configuration by the probe of a conventional tapping apparatus.
Figure 13:
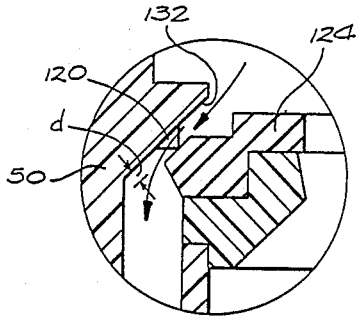
FIG. 13 is an enlarged partial view of the valve of the preceding figure after removal of the tapping apparatus for illustrating the relationship between the valve body, pressure relief ring and outer valve.

The valve remains in the configuration shown in FIG. 12 during use. That is, this configuration remains while the tapping apparatus is in place. Afterward, when the tapping apparatus is removed and the pressure of the probe 108 against the inner valve 134 and that of the washer 110 against the outer valve seal 124 are removed, the valve is reconfigned to the arrangement of FIG. 13, an enlarge partial view of the valve after removal of the tap. When this apparatus is removed, the outer spring 38 once again urges the outer valve upwardly and toward a sealing relationship with the valve body 50. However, as can be seen, the ring 120, having traveled downwardly during tapping, prevents the direct reseating of the surfaces of the outer valve seal 124 and the valve body 50 as in FIG. 9. The ring 120 having expanded to its "rest" (lowest energy state) shape, is not returned to the compressed shape for seating in the notch 122 as a consequence of the interrelationship of the spring constant of the outer spring 38 with the angle of inclination of the surface 132. Therefore, the ring 120 reaches an equilibrium at some intermediate point along the surface 132 as shown and provides a separation distance d as indicated between the two otherwise-sealing elements. The discontinuity in the ring 120, shown clearly in FIG. 10, which provides a passageway in the circumference of the ring 120, thereby provides means for venting the pressure buildup that can occur within a (discarded) disposable container 12 fitted with a valve in accordance with this invention.

Thus it is seen that there has been provided new apparatus for use in conjunction with the disposal of carbonated beverages from a keg. By employing the teachings of this invention, one can be assured that the harmful pressure build-up cannot occur in a keg and therefore may dispose the keg without fear of explosion upon contact with an excessive amount of heat. While the prime utility of the invention occurs in conjunction with valves mounted onto disposable kegs, the claimed invention is also adaptable to, and may be readily and usefully employed with, reusable containers.

While this invention has been described with regard to a presently preferred embodiment, it is not limited thereto. Rather, the scope of this invention is limited only insofar as described in the following set of claims. All equivalents of the claims also fall within their scope.

What is claimed is:

1. In apparatus for dispensing a beverage of the type that includes an inner valve that is urged toward a sealing relationship with an outer valve by means of an inner spring, the improvement comprising:

(a) a resilient safety vent seal located between said inner and said outer valve;

(b) said seal including means for permitting fluid flow between said inner and outer valves; and (c) said safety vent seal is actuated from a first predetermined compressed configuration to a second predetermined uncompressed configuration by the opening of said valve whereby said second configuration prevents an airtight sealing relationship between said inner valve and said outer valve.

2. Apparatus as defined in claim 1 wherein said seal is generally cross-shaped.

3. Apparatus as defined in claim 2 wherein said seal includes a plurality of inclined peripheral portions.

4. Apparatus as defined in claim 3 further characterized in that said peripheral portions of said washer are inclined by approximately ninety degrees in said first configuration.

5. Apparatus as defined in claim 4 wherein said peripheral portions include barbs for interlocking with a circular groove.

6. Apparatus as defined in claim 5 wherein said seal is fabricated of plastic.

7. Apparatus as defined in claim 5 wherein said seal is fabricated of stainless steel.

8. A valve for a beverage container container comprising, in combination:

(a) a valve body;

(b) an inner valve including a first valve member that is urged toward a sealing relationship with a second valve member by a spring; and (c) means for preventing a sealing relationship between said first valve member and said second valve member once said second valve member has been depressed, said means including a generally cross shaped washer of resilient composition.

9. A valve as defined in claim 8 further including a membrane for sealing said valve body.

10. In apparatus for dispensing a beverage of the type that includes an inner valve and an outer valve within a valve body, said inner valve being urged toward a sealing relationship with said outer valve by means of an inner spring and said outer valve being urged toward a sealing relationship with said valve body by an outer spring, the improvement comprising:

(a) a resilient, generally C-shaped ring having an inclined peripheral edge and located intermediate said outer valve and said valve body said ring being arranged so that said inclined peripheral edge is adjacent a matching inclined portion of said valve body; and (b) an aperture of predetermined shape and location is formed in said ring to permit fluid flow between said body and said outer valve.

11. A valve as defined in claim 10 further characterized in that said outer valve includes an annular notch for accepting said C-shaped ring.

12. A valve as defined in claim 11 wherein:

(a) said resilient ring is radially compressed by said valve body when seated within said annular notch; and (b) said ring expands outwardly and travels along the axis of said valve upon separation of said outer seal from said valve body.

* * * * *